US011712117B1

(12) United States Patent
Geehan

(10) Patent No.: US 11,712,117 B1
(45) Date of Patent: Aug. 1, 2023

(54) ELEVATED BENCH SEATING SUPPORT

(71) Applicant: Timothy Geehan, Chanhassen, MN (US)

(72) Inventor: Timothy Geehan, Chanhassen, MN (US)

(73) Assignee: Timothy Geehan, Chanhassen, MN (US)

( * ) Notice: Subject to any disclaimer, the term of this patent is extended or adjusted under 35 U.S.C. 154(b) by 72 days.

(21) Appl. No.: 17/375,068

(22) Filed: Jul. 14, 2021

Related U.S. Application Data

(60) Provisional application No. 63/078,601, filed on Sep. 15, 2020, provisional application No. 63/053,829, filed on Jul. 20, 2020.

(51) Int. Cl.
*A47C 1/16* (2006.01)
*A47C 4/03* (2006.01)
*A47C 4/02* (2006.01)

(52) U.S. Cl.
CPC ..... *A47C 1/16* (2013.01); *A47C 4/021* (2013.01); *A47C 4/03* (2013.01)

(58) Field of Classification Search
CPC ..... A47C 11/00; A47C 13/00; A47C 1/16
USPC ..... 297/117, 188.04, 188.06
See application file for complete search history.

(56) References Cited

U.S. PATENT DOCUMENTS

| | | | | |
|---|---|---|---|---|
| 226,156 | A * | 4/1880 | Blackler | 297/217.7 |
| 2,450,301 | A * | 9/1948 | Quiggle | A47D 1/103 297/255 |
| 5,098,155 | A * | 3/1992 | Graber | A47C 11/00 211/20 |
| 6,854,798 | B1 * | 2/2005 | Mason | A47C 5/10 297/352 |
| 8,479,664 | B2 * | 7/2013 | Nelson | A47B 5/04 108/42 |
| 8,857,347 | B1 * | 10/2014 | Liu | A47B 5/02 108/47 |
| 9,986,842 | B1 * | 6/2018 | Belcher | A47C 7/70 |

* cited by examiner

*Primary Examiner* — Sarah B McPartlin
(74) *Attorney, Agent, or Firm* — Michael A. Bondi; Moss & Barnett

(57) ABSTRACT

An elevated bench seating support including a top panel, a first brace and a second brace. The first brace is operably attached to the top panel. The second brace is operably attached to the first brace to retain a bench back between the first brace and the second brace when the elevated bench seating support is used in conjunction with a bench.

20 Claims, 6 Drawing Sheets

ELEVATED BENCH SEATING SUPPORT

REFERENCE TO RELATED APPLICATION

This application claims priority to Provisional Applic. No. 63/053,829, filed on Jul. 20, 2020, and Provisional Applic. No. 63/078,601, filed on Sep. 15, 2020, the contents of which are incorporated herein by reference.

FIELD OF THE INVENTION

The invention relates generally to seating. More particularly, the invention relates to an elevated bench seating support.

BACKGROUND OF THE INVENTION

When playing sports such as baseball and softball, it is customary for the players who are not on the field to stay in an area that is adjacent to the field on which the game is being played so that the players can watch the game such as while waiting to bat or otherwise waiting to play in the game.

In certain fields, a bench is provided on which the players can sit while watching the game. Because of the size of the field, there may be challenges in seeing what is happening at all areas of the baseball or softball field when sitting on the bench especially when other people are standing or sitting in front of the bench.

One technique that is frequently used to enhance the ability to see the field when the bench includes a back is for the players to sit on the bench back. While sitting on the bench back enhances the ability of the players to see what is happening on the field, the upper surface of the bench back is typically relatively narrow. In addition to not being comfortable to sit on for extended periods of time, the narrow upper surface of the bench back can pose a hazard with respect to the players leaning too far backwards and falling off the bench.

SUMMARY OF THE INVENTION

An embodiment of the invention is directed to an elevated bench seating support including a top panel, a first brace and a second brace. The first brace is operably attached to the top panel. The second brace is operably attached to the first brace to retain a bench back between the first brace and the second brace when the elevated bench seating support is used in conjunction with a bench.

Another embodiment of the invention is directed to a bench seating system including a bench and an elevated bench seating support. The bench includes a seat and a back that is mounted with respect to the seat. The elevated bench seating support includes a top panel, a first brace and a second brace. The first brace is operably attached to the top panel. The second brace is operably attached to the first brace to retain the bench back between the first brace and the second brace when the elevated bench seating support is used in conjunction with the bench.

Another embodiment of the invention is directed to a method of using an elevated bench seating support. A bench is provided that includes a seat and a back that is mounted with respect to the seat. An elevated bench seating support is provided that includes a top panel, a first brace and a second brace. The first brace is operably attached to the top panel. The second brace is operably attached to the first brace. A portion of the bench back is position between the first brace and the second brace. A buttock of a person sits on the top panel to support the person at an elevated height as compared to the person sitting with the person's buttocks on the bench seat.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 7:
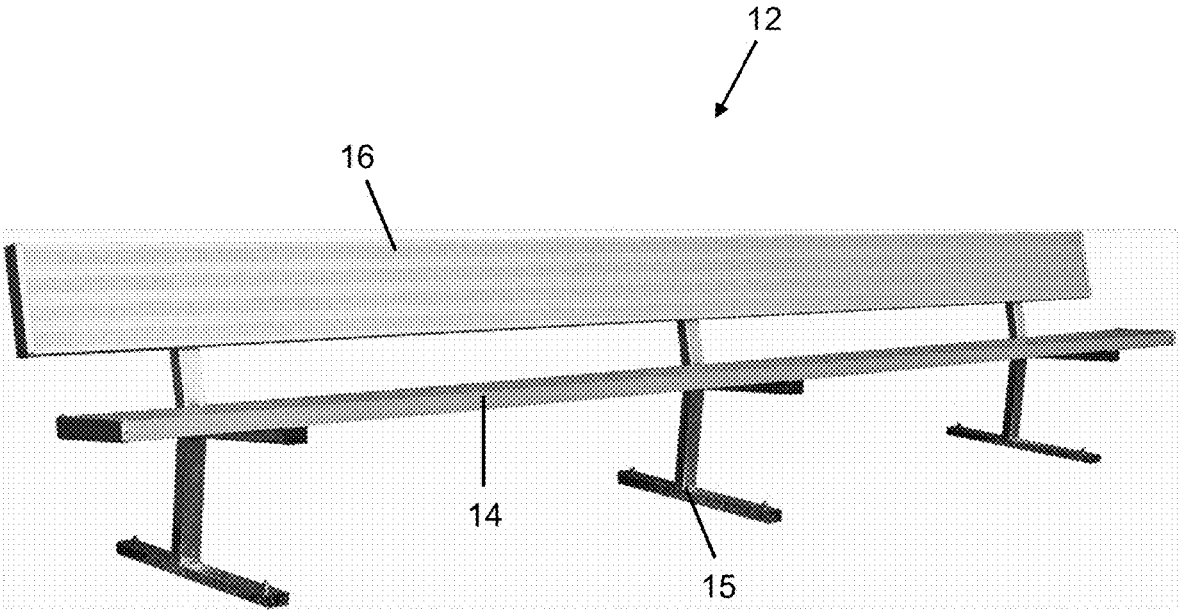
FIG. 7 is a perspective view of a bench with which the elevated bench seating support is capable of being used.

An embodiment of the invention is directed to an elevated bench seating support as illustrated at 10 in FIGS. 1-5. The elevated bench seating support 10 is adapted for use in conjunction with a bench 12, which is illustrated in FIG. 7.

In certain embodiments, the bench 12 has a seat 14 that is supported above a ground surface with at least one leg 15. The bench 12 also has a back 16 that is angularly mounted with respect to the seat 14 such that when a person sits on the seat 14, the back 16 is capable of supporting the person's back. In certain situations, the bench 12 is secured to the ground surface.

When used in conjunction with the bench 12, the elevated bench seating support 10 thereby enables a person to comfortably and safely sit at an elevated height as compared to sitting on the bench seat 14. The elevated bench seating support 10 thereby provides the person with an enhanced ability to see what is happening such as on the baseball field that is adjacent to the bench 12 on which the elevate bench seating support 10 is used.

The elevated bench seating support 10 has a relatively light weight such as less than about 1 pound, which enables the elevated bench seating support 10 to be readily carried by itself or placed in a sports equipment bag for transporting to and from the use location such as an athletic field.

The elevated bench seating support 10 may be transported in an assembled configuration. Alternatively, the elevated bench seating support 10 may be disassembled such as to take up less space in a sports equipment bag.

Figure 1:
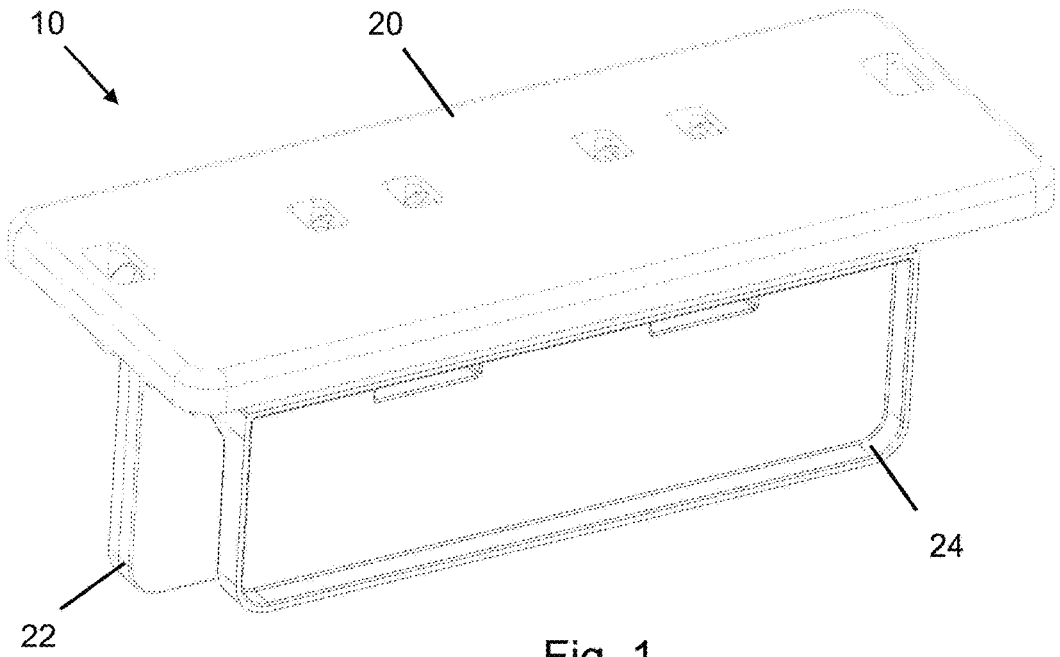
FIG. 1 is an upper perspective view of an elevated bench seating support according to an embodiment of the invention.
Figure 2:
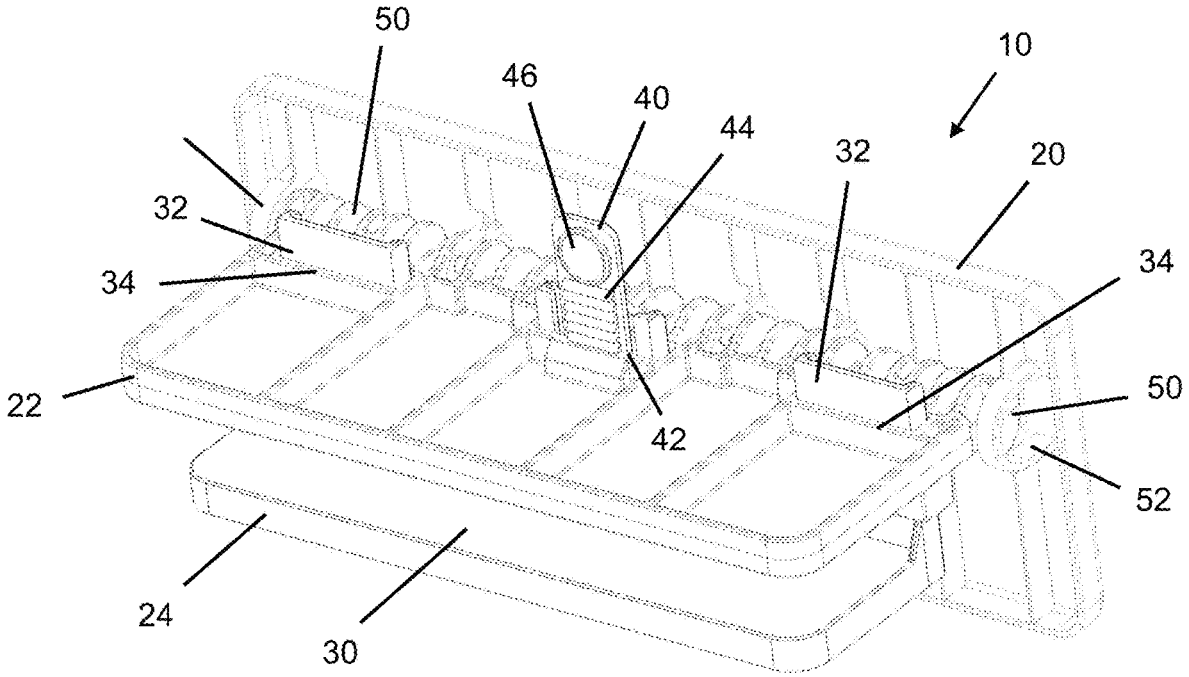
FIG. 2 is a lower perspective view of the elevated bench seating support of FIG. 1
Figure 3:
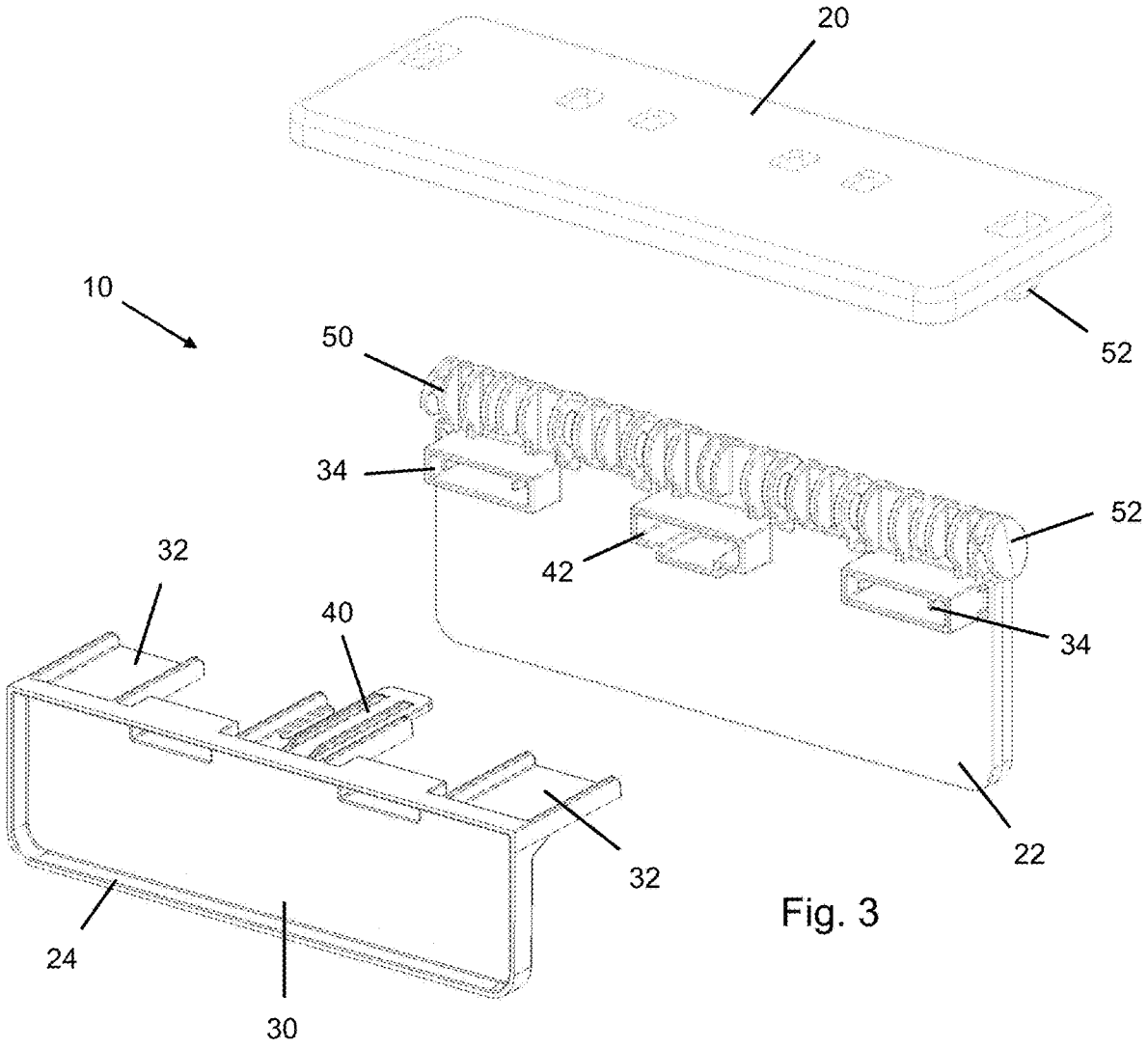
FIG. 3 is an exploded perspective view of the element bench seating support of FIG. 1.
Figure 4:
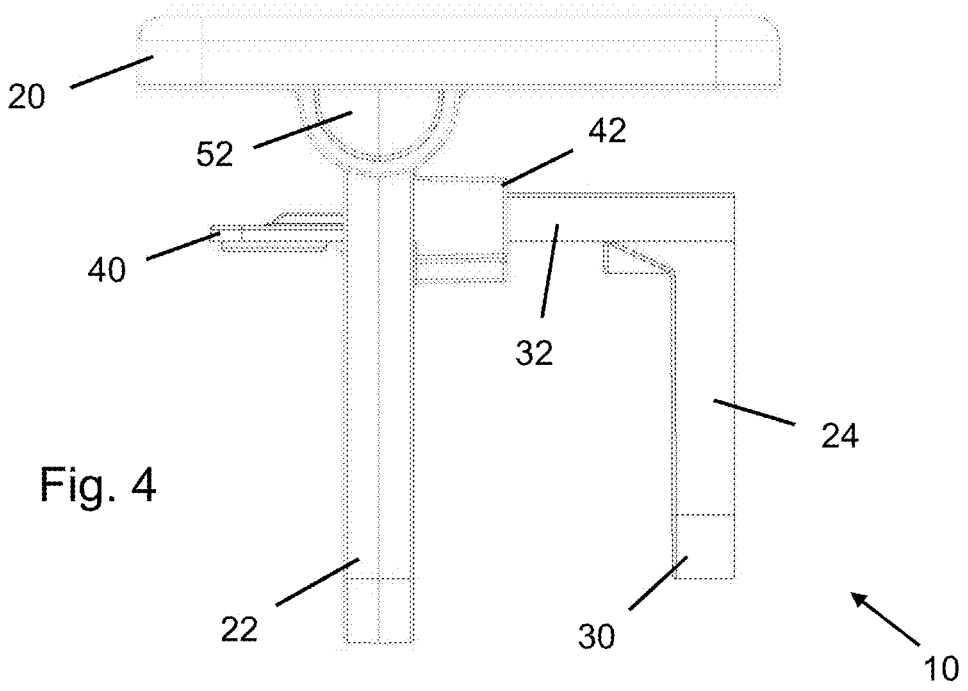
FIG. 4 is a side view of the elevated bench seating support of FIG. 1 with a second brace in a first position with respect to a first brace.
Figure 5:
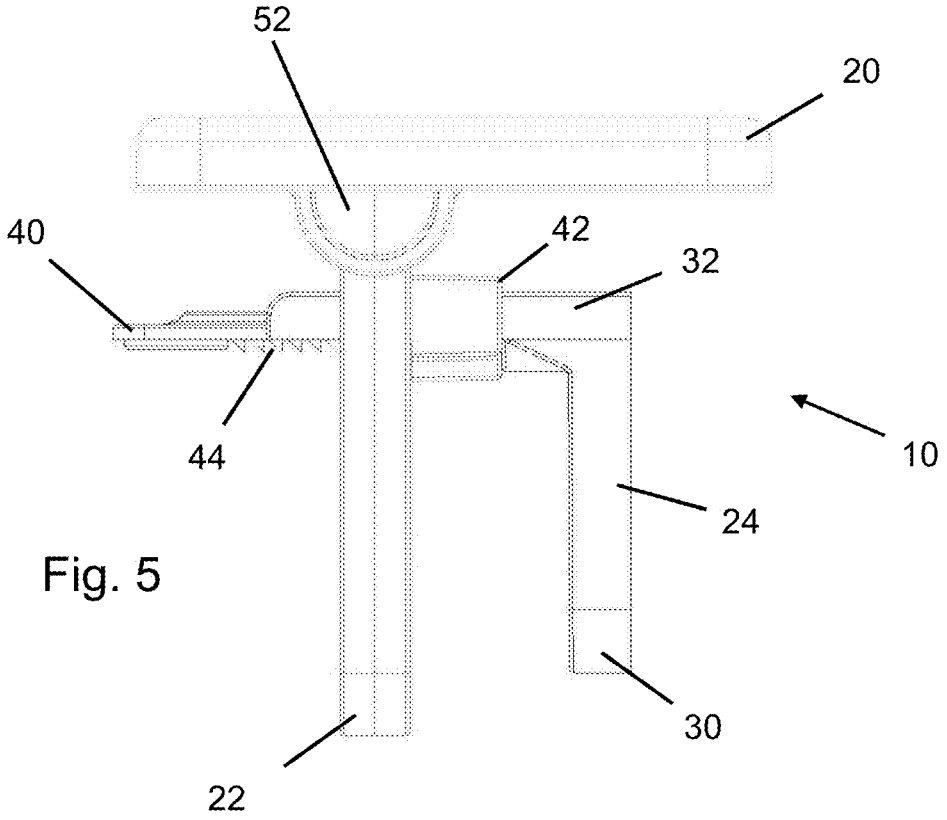
FIG. 5 is a side view of the elevated bench seating support of FIG. 1 with the second brace in a second position with respect to the first brace.

The elevated bench seating support 10 generally includes a top panel 20, a first brace 22 and a second brace 24. In certain embodiments, the top panel 20 may have a generally rectangular configuration as illustrated in FIGS. 1-3.

The top panel 20 may be fabricated with a width and a depth that are sufficiently large to support a substantial portion of a person's buttocks is using the elevated bench seating support 10. By supporting the substantial portion of the person's buttocks is using the elevated bench seating support 10, the person experiences a greater level of comfort as compared to sitting on the relatively narrow upper surface of the bench back 16 such as is illustrated in FIG. 7.

Figure 6:
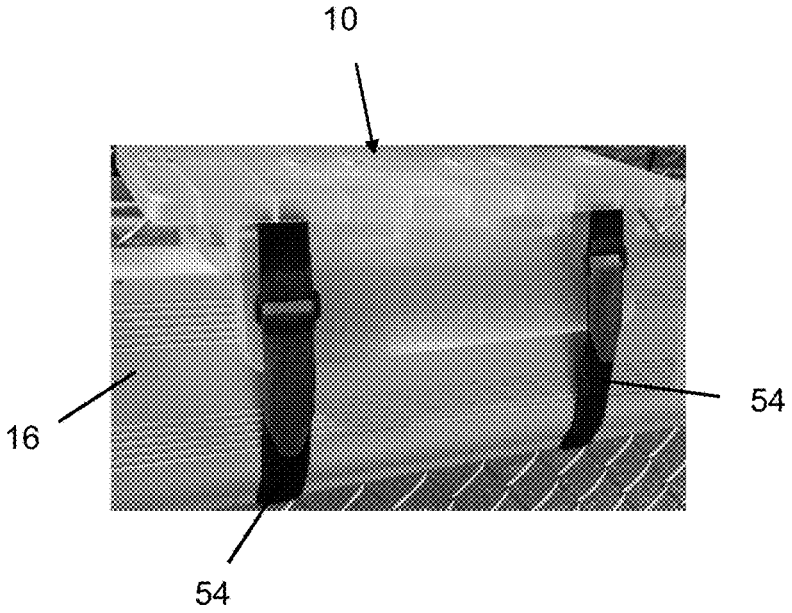
FIG. 6 is a perspective view of the elevated bench seating support secured to the back portion of a bench with a plurality of straps.

To further reduce the potential of the elevated bench seating support 10 moving with respect to the bench back 16, it is possible to secure the elevated bench seating support 10 to the bench back 16 with at least one strap 54, as illustrated in FIG. 6. The strap 54 may extend through the opening 34.

A person of skill in the art will appreciate that the strap 54 may include a variety of attachment mechanisms to secure the strap 54. An example of one suitable attachment mechanism is a hook and loop fastener such as available under the designation VELCRO.

As used herein, substantial means that greater than about 60 percent of the person's buttocks using the elevated bench seating support 10 is positioned on the top panel 20 and less than about 40 percent of the buttocks extends beyond side edges of the top panel 20. In other embodiments, substantial means that greater than about 80 percent of the person's buttocks using the elevated bench seating support 10 is positioned on the top panel 20 and less than about 20 percent of the buttocks extends beyond side edges of the top panel 20.

The width of the top panel 20 may be selected based upon whether the person is an adult or a youth. In certain embodiments, when the person is an adult, the width of the top panel 20 is about 13 inches and when the person is a youth, the width is about 11 inches.

The depth of the top panel 20 may be between about 4 inches and about 6 inches. In certain embodiments, the depth of the top panel 20 is about 5 inches. An upper surface of the top panel 20 may have a texture that reduces the potential of a person sitting on the elevated bench seating support 10 from inadvertently slipping.

The top panel 20 may be fabricated from a relatively thin material that resists deformation during use of the elevated bench seating support 10. As such, a thickness of the top panel 20 may be affected by the material that is used to fabricate to top panel 20. In certain embodiments, the top panel 20 has a thickness of less than about 1 inch. In other embodiments, the top panel 20 has a thickness of about ½ of an inch. Examples of two materials that are suitable for fabricating the top panel 20 are plastic and wood.

In certain embodiments, the first brace 22 is pivotally attached to the top panel 20 using at least one first engagement mechanism 50 that extends from a lower surface of the top panel 20 and at least one second engagement mechanism 52 that extends from an upper end of the first brace. There may me a plurality of first engagement mechanisms 50 and a plurality of second engagement mechanisms 52 oriented in an alternating relationship when the first brace 22 is attached to the top panel 20.

The first engagement mechanism 50 may have a generally circular shape as illustrated in FIG. 3. The first engagement mechanism 50 is oriented at an angle with respect to a side of the first brace 22. In certain embodiments, the angle is between about 5 degrees and about 15 degrees. Orienting the first engagement mechanism 50 at an angle enables part of the first engagement mechanism 50 to extend into an aperture in the second engagement mechanism 52. Such a configuration retains the first brace 22 in engagement with the top panel 20 while permitting the first brace 22 to rotate with respect to the top panel 20.

An advantage of pivotally attaching the first brace 22 to the top panel 20 is that when the elevated bench seating support 10 is mounted to the bench 12, it is possible for the user to adjust an orientation of the top panel 20 based upon the user's preferences.

The second brace 24 generally includes a lower brace portion 30 and at least one extension 32 that extends from the lower brace portion 30 proximate an upper edge thereof. In certain embodiments, two extensions 32 extend from the lower brace portion 30 and the extensions are positioned proximate opposite edge of the lower brace portion 30.

The extensions 32 are oriented at an angle with respect to the lower brace portion 30. In certain embodiments, the extensions 32 are oriented substantially perpendicular to the lower brace portion 30.

When the second brace 24 is attached to the first brace 22, the extensions 32 extend through openings 34 in the first brace 22. Each opening 34 may have a width and a height that are similar to a width and a height of the extension 32. This configuration limits sliding of the second brace 24 with respect to the first brace 22 to along an axis.

The second brace 24 also includes an engagement extension 40 that extends from the lower brace portion 30. The engagement extension 40 may be intermediate the extensions 32, as illustrated in FIGS. 2 and 3.

When the second brace 24 is attached to the first brace 22, the engagement extension 40 extends through an engagement opening 42 in the first brace 22. The engagement opening 42 may have a width and a height that are similar to a width and a height of the engagement extension 40. This configuration limits sliding of the second brace 24 with respect to the first brace 22 to along an axis.

The engagement extension 40 has a plurality of teeth 44 that extend from a surface thereof. The teeth 44 engage the first brace 22 proximate the engagement opening 42 through which the engagement extension 40 extends. The teeth 44 thereby retain the first brace 22 in a fixed position with respect to the second brace 24. When a force is applied to a distal end 46 of the engagement extension 40, the teeth 44 disengage the opening 42 and the distance between the first brace 22 and the second brace can change. The distal end 46 of the engagement extension 40 may have a circular indention formed therein to facilitate a user identifying the location at which the force should be applied.

The first brace 22 and the second brace 24 may each be formed with a height that is sufficiently large to reduce the potential of the elevated bench seating support 10 moving when place over the top of the bench back 16.

In certain embodiments, the top panel 20, the first brace 22 and the second brace 24 are fabricated from different pieces of material are attached together when assembling the elevated bench seating support 10. An advantage of such a configuration is that it may be possible to adjust a spacing between the first brace 22 and the second brace 24.

In use, the first brace 22 is attached to the top panel 20 by putting the first engagement mechanism 50 into engagement with the second engagement mechanism 52. The extensions 32 are extended through the openings 34 and the engagement extension 40 is extended through the opening 42 to attach the second brace 24 to the first brace.

The elevated bench seating support 10 is moved so that the bench back 16 extends between the first brace 22 and the second brace 24 until an upper surface of the bench back 16 contacts the extensions 32. Next, the second brace 24 is urged towards the first brace 22 so that a distance between the first brace 22 and the second brace 24 is approximately equal to a distance between front and back surfaces of the bench back 16.

The teeth 44 engage the first brace 22 proximate the opening 42 to retain the second brace 24 in a fixed position with respect to the first brace 22. The person then sits on the top panel 20 which enables the person to comfortably and safely sit at a height that is greater than the height when the person is sitting on the bench seat 14.

Figure 8:
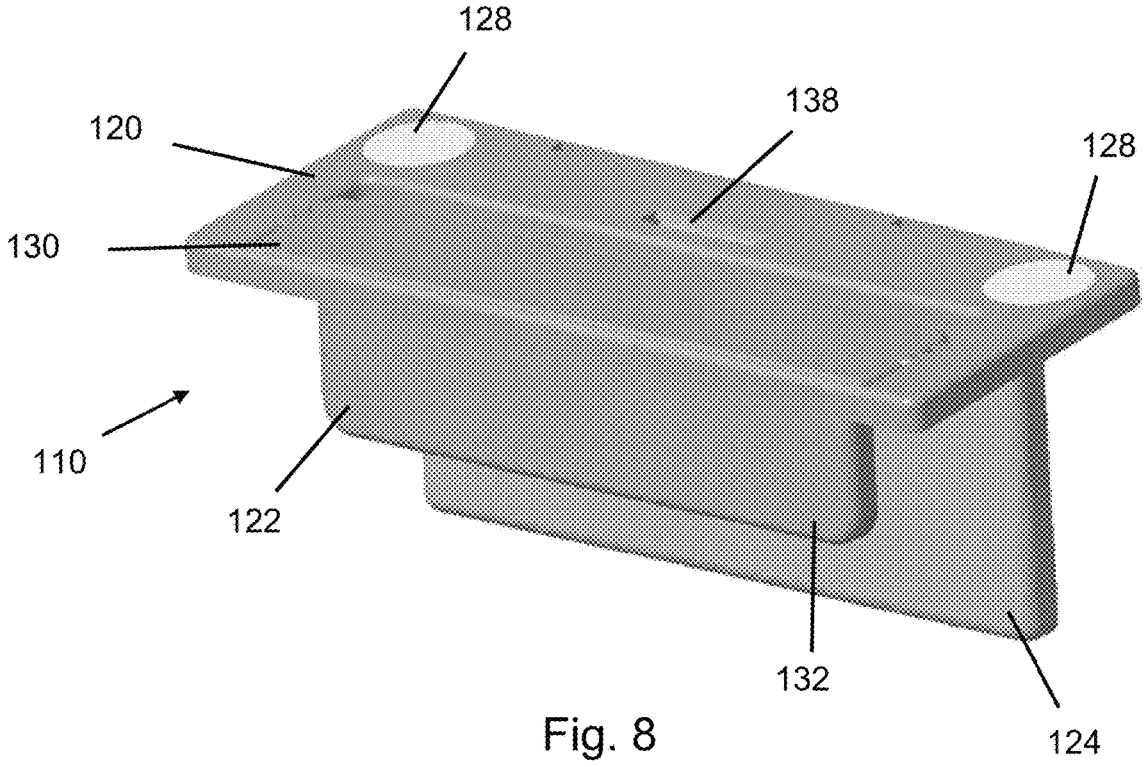
FIG. 8 is an upper perspective view of an elevated bench seating support according to another embodiment of the invention.
Figure 9:
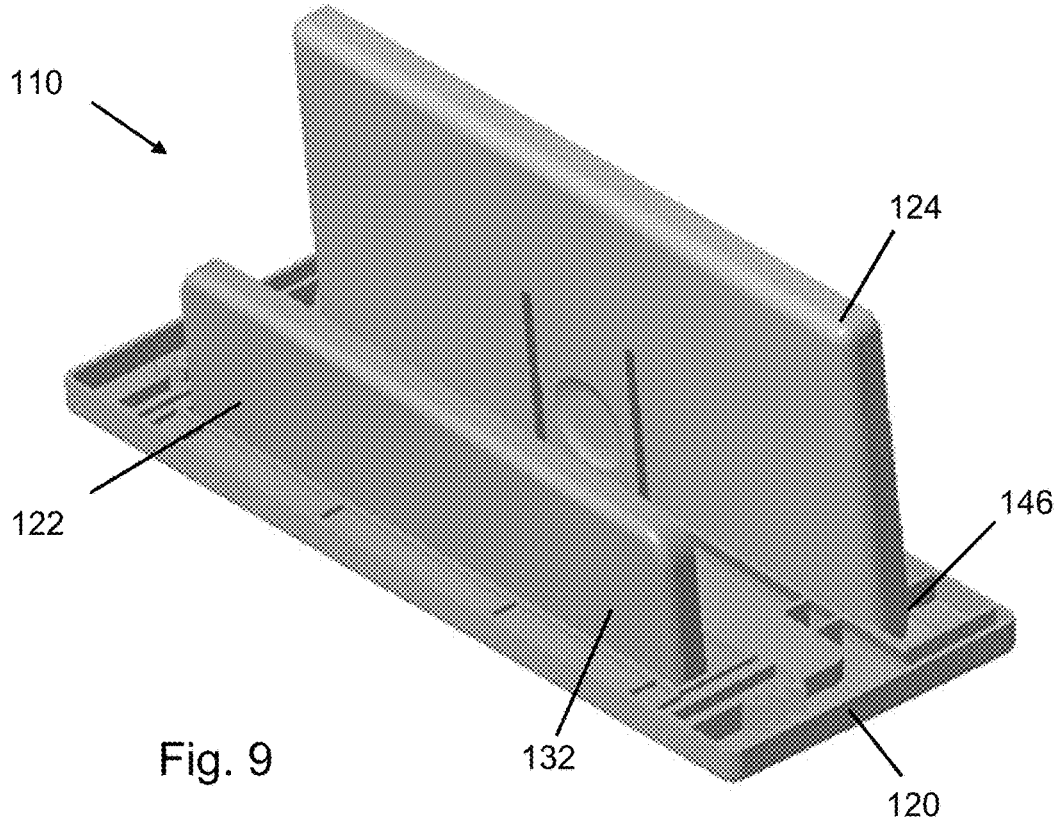
FIG. 9 is a lower perspective view of the elevated bench seating support of FIG. 8.
Figure 10:
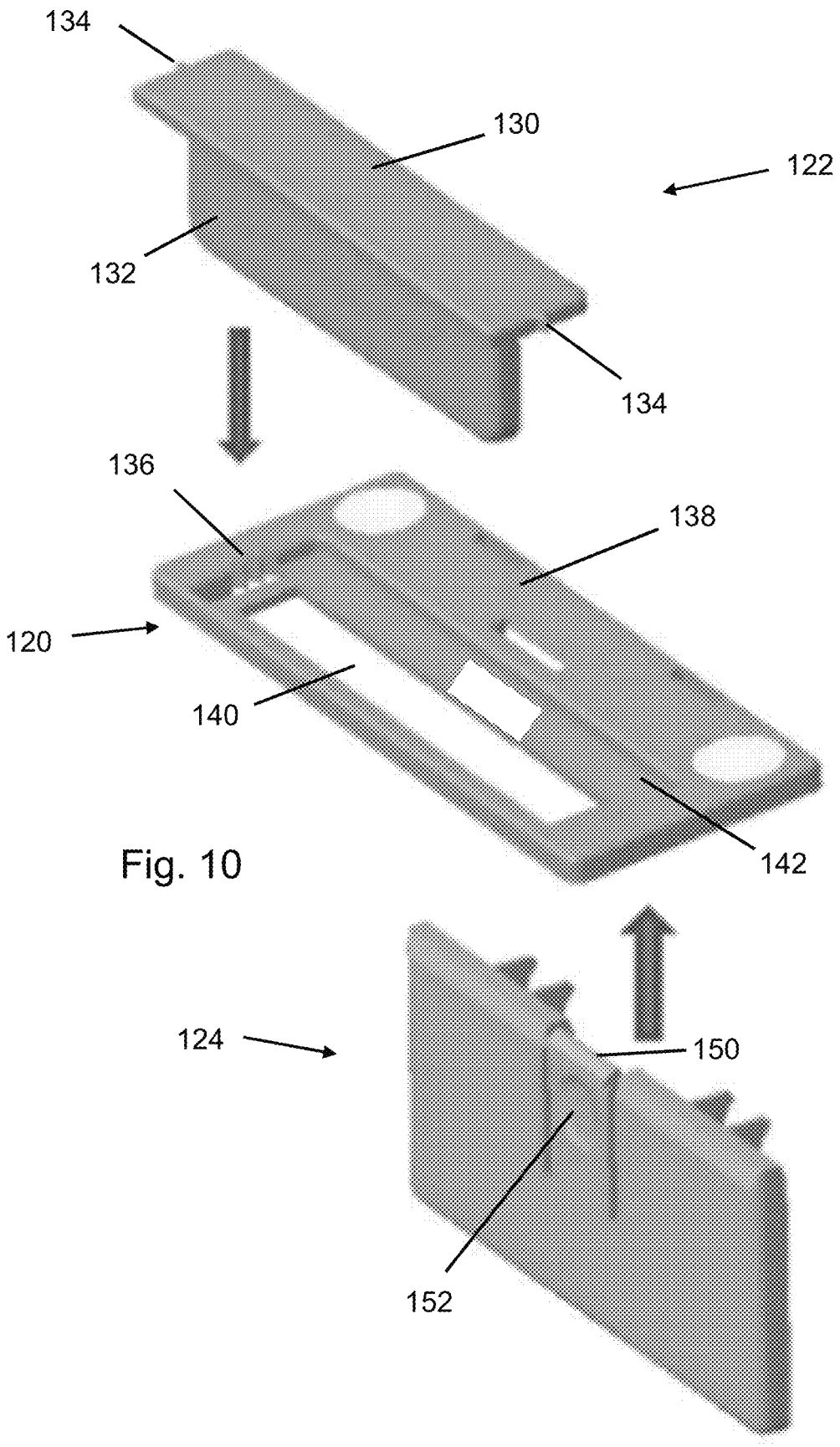
FIG. 10 is an exploded perspective view of the elevated bench seating support of FIG. 8.

Another embodiment of the invention is directed to an elevated bench seating support as illustrated at 110 in FIGS. 8-10. The elevated bench seating support 110 is adapted for use in conjunction with a bench having a back such as illustrated in FIG. 7.

When used in conjunction with the bench, the elevated bench seating support 110 thereby enables a person to comfortably and safely sit at an elevated height as compared to sitting on the bench. The elevated bench seating support 110 thereby provides the person with an enhanced ability to see what is happening such as on the baseball field that is adjacent to the bench on which the elevate bench seating support 110 is used.

The elevated bench seating support 110 has a relatively light weight such as less than about 1 pound, which enables the elevated bench seating support 110 to be readily carried by itself or placed in a sports equipment bag for transporting to and from the use location such as an athletic field.

The elevated bench seating support 110 may be transported in an assembled configuration. Alternatively, the elevated bench seating support 110 may be disassembled such as to take up less space in a sports equipment bag.

The elevated bench seating support 110 generally includes a top panel 120, a first brace 122 and a second brace 124. In certain embodiments, the top panel 120 may have a generally rectangular configuration as illustrated in FIGS. 8-10.

The top panel 120 may be fabricated with a width and a depth that are sufficiently large to support a substantial portion of a person's buttocks is using the elevated bench seating support 110. By supporting the substantial portion of the person's buttocks is using the elevated bench seating support 110, the person experiences a greater level of comfort as compared to sitting on the relatively narrow upper surface of the bench back.

As used herein, substantial means that greater than about 60 percent of the person's buttocks using the elevated bench seating support 110 is positioned on the top panel 120 and less than about 40 percent of the buttocks extends beyond side edges of the top panel 120. In other embodiments, substantial means that greater than about 80 percent of the person's buttocks using the elevated bench seating support 110 is positioned on the top panel 120 and less than about 20 percent of the buttocks extends beyond side edges of the top panel 120.

The width of the top panel 120 may be selected based upon whether the person is an adult or a youth. In certain embodiments, when the person is an adult, the width of the top panel 120 is about 13 inches and when the person is a youth, the width is about 11 inches.

The depth of the top panel 120 may be between about 4 inches and about 6 inches. In certain embodiments, the depth of the top panel 120 is about 5 inches.

An upper surface of the top panel 120 may have a texture that reduces the potential of a person sitting on the elevated bench seating support 110 from inadvertently slipping. The upper surface of the top panel 120 may include at least one identification region 128 with a relatively smooth surface. The at least one identification region 128 may be used to apply a sticker such as relating to the team and/or league that the person using the elevated bench seating support 110 is playing for. Alternatively or additionally, the at least one identification region 128 may be used to write the name and other identifying information of the person who is using the elevated bench seating support.

The at least one identification region 128 may be slightly recessed with respect to the other parts of the upper surface of the top panel 120 to reduce the potential of what is placed in the at least one identification region 128 being worn off or damaged during use of the elevated bench seating support 110.

The top panel 120 may be fabricated from a relatively thin material that resists deformation during use of the elevated bench seating support 110. As such, a thickness of the top panel 120 may be affected by the material that is used to fabricate to top panel 120. In certain embodiments, the top panel 120 has a thickness of less than about 1 inch. In other embodiments, the top panel 120 has a thickness of about ½ of an inch. Examples of two materials that are suitable for fabricating the top panel 120 are plastic and wood.

The first brace 122 and the second brace 124 are attached to the top panel 120 in spaced-apart configuration. The spacing between the first brace 122 and the second brace 124 is selected to be slightly larger than a thickness of the bench back such that when the elevated bench seating support 10 is used, an upper edge of the bench back extends between the first brace 122 and the second brace 124.

The first brace 122 and the second brace 124 may each be formed with a height that is sufficiently large to reduce the potential of the elevated bench seating support 110 moving when place over the top of the bench back.

In certain embodiments, the first brace 122 and the second brace 124 may be attached to the top panel at an angle of other than 90 degrees. Using such a configuration causes the top panel 120 to lean forward that reduces the potential of pressure points on the person's buttocks sitting on the elevated bench seating support 110. Additionally, the forward angle encourages the person sitting on the elevated bench seating support 110 to lean forward to avoid potential danger associated with the person leaning backwards when sitting on the elevated bench seating support. In certain embodiments, the angle is up to about 15 degrees. In other embodiments, the angle is about 10 degrees.

In certain embodiments, the top panel 120, the first brace 122 and the second brace 124 are fabricated from different pieces of material are attached together when assembling the elevated bench seating support 110. An advantage of such a configuration is that it may be possible to adjust a spacing between the first brace 122 and the second brace 124. In other embodiments, the top panel 120, the first brace 122 and the second brace 124 may be formed in a single piece such as from injection molded plastic. An advantage of such a configuration is that it reduces assembly costs and reduces the potential of fasteners failing.

In one embodiment, the top panel 120 includes a slot 140 through which a portion of the first brace 122 is extendable for securing the first brace 122 to the top panel 120. Along at least one edge of the slot 140, the top panel 120 has a least one notch 136 formed therein. In certain embodiments, there are a plurality of notches 136 formed in the top panel 120. The plurality of notches enable a position of the first brace 122 to be adjusted with respect to the top panel 120 as is described in more detail herein. The top panel 120 may also include a recess 142 formed therein from an upper surface thereof.

The first brace 122 may be adjustably mounted to the top panel 120 to change a distance between the first brace 122 and the second brace 124. In one such configuration, the first brace 122 includes a lower brace portion 132 and an upper brace portion 130. The lower brace portion 132 may be oriented generally perpendicular to the upper brace portion 130. The upper brace portion 130 has at least one tab 134 extending therefrom. The tab 134 may be shaped generally complementary with respect to the notch 136. In one such configuration, the tab 134 and the notch 136 both have a generally triangular shape.

When the first brace 122 is attached to the top panel 120, the lower brace portion 132 extends through the slot 140 and the upper brace portion 130 at least partially seats in the recess 142. Changing which notch 136 the tab 134 extends into enables the first brace 122 to be maintained at different distances from the second brace 124.

The second brace 124 seats in a channel 146 in a lower surface of the top panel 120. The channel 146 may have a length and a width that are similar to yet slightly larger than a length and a width of the second brace 124.

The second brace 124 may removably engage the top panel 120 using a bendable tab 150 on the second brace 124 that extends into an opening 138 in the top panel 120. When it is desired to detach second brace 124 from the top panel 120, the bendable tab 150 is pressed, which causes the second brace 124 to be separable from the top panel 120. The bendable tab 150 may have a recess 152 formed in a surface thereof to assist a user to identify the location of the bendable tab 150. In certain embodiments, the recess 152 may have a generally circular shape.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An elevated bench seating support comprising:

a top panel;

a first brace that comprises an opening, wherein the first brace is operably attached to the top panel; and a second brace that comprises a lower brace portion and at least one extension that extends from the lower brace portion, wherein the at least one extension is extendable through the opening to operably attach the second brace to the first brace to retain a bench back between the first brace and the second brace when the elevated bench seating support is used in conjunction with a bench having the bench back.

2. The elevated bench seating support of claim 1, wherein the top panel is capable of supporting a substantial portion of a person's buttocks sitting on the elevated bench seating support.

3. The elevated bench seating support of claim 1, wherein the first brace is pivotally attached to the top panel using a first engagement mechanism attached to the top panel and a second engagement mechanism that is attached to the first brace.

4. The elevated bench seating support of claim 3, wherein the first engagement mechanism comprises a plurality of first engagement mechanisms, wherein the second engagement mechanism comprises a plurality of second engagement mechanism and wherein the plurality of first engagement mechanisms and the plurality of second engagement mechanisms are oriented in an alternating relationship when the first brace is attached to the top panel.

5. The elevated bench seating support of claim 1, wherein the at least one extension is oriented substantially perpendicular to the lower brace portion.

6. The elevated bench seating support of claim 1, wherein the second brace further comprises an engagement extension that extends from the lower brace portion, wherein the engagement extension has a plurality of teeth extending therefrom, wherein the first brace further comprises an engagement opening through which the engagement extension extends when the second brace is operably attached to the first brace and wherein at least one of the plurality of teeth engage the first brace proximate the engagement opening to retain the second brace in a fixed position with respect to the first brace.

7. A bench seating system comprising:

a bench comprising a seat and a back that is mounted with respect to the seat; and an elevated bench seating support comprising:

a top panel;

a first brace that is pivotally attached to the top panel; and a second brace that is slidably attached to the first brace to retain the bench back between the first brace and the second brace when the elevated bench seating support is used in conjunction with the bench.

8. The bench seating system of claim 7, wherein the top panel is capable of supporting a substantial portion of a person's buttocks sitting on the elevated bench seating support.

9. The bench seating system of claim 7, wherein the first brace is pivotally attached to the top panel using a first engagement mechanism attached to the top panel and a second engagement mechanism that is attached to the first brace.

10. The bench seating system of claim 9, wherein the first engagement mechanism comprises a plurality of first engagement mechanisms, wherein the second engagement mechanism comprises a plurality of second engagement mechanisms and wherein the plurality of first engagement mechanisms and the plurality of second engagement mechanisms are oriented in an alternating relationship when the first brace is attached to the top panel.

11. The bench seating system of claim 7, wherein the second brace comprises a lower brace portion and at least one extension that extends from the lower brace portion and wherein the first brace comprises an opening through which the at least one extension extends when the second brace is operably attached to the first brace.

12. The bench seating system of claim 11, wherein the at least one extension is oriented substantially perpendicular to the lower brace portion.

13. The bench seating system of claim 11, wherein the second brace further comprises an engagement extension that extend from the lower brace portion, wherein the engagement extension has a plurality of teeth extending therefrom, wherein the first brace further comprises an engagement opening through which the engagement extension extends when the second brace is operably attached to the first brace and wherein at least one of the plurality of teeth engage the first brace proximate the engagement opening to retain the second brace in a fixed position with respect to the first brace.

14. A method of using an elevated bench seating support comprising:

providing a bench comprising a seat and a back that is mounted with respect to the seat;

providing an elevated bench seating support comprising a top panel, a first brace and a second brace;

pivotally attaching the first brace to the top panel;

slidably attaching a second brace to the first brace;

positioning a portion of the bench back between the first brace and the second brace; and sitting a buttock of a person on the top panel to support the person at an elevated height as compared to the person sitting with the person's buttocks on the bench seat.

15. The method of claim 14, wherein a substantial portion of the person's buttocks are on the top panel.

16. The method of claim 14, wherein the first brace is pivotally attached to the top panel using a first engagement mechanism attached to the top panel and a second engagement mechanism that is attached to the first brace.

17. The method of claim 16, wherein the first engagement mechanism comprises a plurality of first engagement mechanisms, wherein the second engagement mechanism comprises a plurality of second engagement mechanisms and wherein the plurality of first engagement mechanisms and the plurality of second engagement mechanisms are oriented in an alternating relationship when the first brace is attached to the top panel.

18. The method of claim 14, wherein the second brace comprises a lower brace portion and at least one extension that extends from the lower brace portion, wherein the at least one extension is oriented substantially perpendicular to the lower brace portion, wherein the first brace comprises an opening and wherein the at least one extension extends through the opening when the second brace is operably attached to the first brace.

19. The method of claim 14, wherein the second brace further comprises an engagement extension that extend from the lower brace portion, wherein the engagement extension has a plurality of teeth extending therefrom, wherein the first brace further comprises an engagement opening, wherein the engagement extension extends through the engagement opening when the second brace is operably attached to the first brace and wherein at least one of the plurality of teeth engage the first brace proximate the engagement opening to retain the second brace in a fixed position with respect to the first brace.

20. The method of claim 14, and further comprising pivoting the top panel with respect to the bench back while the bench back is retained between the first brace and the second brace.

* * * * *